US011713604B2

(12) United States Patent
Linden

(10) Patent No.: US 11,713,604 B2
(45) Date of Patent: Aug. 1, 2023

(54) SPLIT RIGID AND FLEXIBLE DOOR STOP MECHANISM

(71) Applicant: Kurt R. Linden, Oxnard, CA (US)

(72) Inventor: Kurt Linden, Oxnard, CA (US)

( * ) Notice: Subject to any disclaimer, the term of this patent is extended or adjusted under 35 U.S.C. 154(b) by 0 days.

(21) Appl. No.: 17/074,418

(22) Filed: Oct. 19, 2020

(65) Prior Publication Data

US 2022/0120121 A1 Apr. 21, 2022

(51) Int. Cl.
*E05C 17/00* (2006.01)
*E05C 17/12* (2006.01)
*E05C 17/36* (2006.01)

(52) U.S. Cl.
CPC ..... *E05C 17/12* (2013.01); *E05C 17/36* (2013.01); *E05Y 2900/132* (2013.01)

(58) Field of Classification Search
CPC ..... E05C 17/12; E05C 17/36
See application file for complete search history.

(56) References Cited

U.S. PATENT DOCUMENTS 52,497 A * 2/1866 Perry et al. ..... E05F 5/025 33/DIG. 6
102,427 A * 4/1870 Peck ..... E05F 5/06 16/86 A
356,115 A * 1/1887 Frothingham ..... E05F 5/025 292/DIG. 16
416,465 A * 12/1889 Lawson ..... E05C 19/063 292/17
456,945 A * 8/1891 Dudden ..... E05F 3/02 16/85
511,662 A * 12/1893 Tsylor et al. ..... E05C 19/063 16/86 A
615,034 A * 11/1898 Merrill ..... E05F 5/025 16/85
731,342 A * 6/1903 Coffman ..... E05C 19/063 292/DIG. 19
733,936 A * 7/1903 Barrett ..... F16F 1/128 267/71
752,375 A * 2/1904 Cole ..... E05C 19/063 292/17

(Continued)

*Primary Examiner* — Jason W San
(74) *Attorney, Agent, or Firm* — Jaye G. Heybl

(57) ABSTRACT

A door stop mechanisms is disclosed that is arranged for preventing a door from swinging back against a wall. The door stop mechanisms are flexible, wall mounted door stops to absorb the impact of the swinging door or other mechanisms imparting a sideways force. The door stops are also arranged to absorb the force, flex, and return, without damage to the mechanism. One embodiment of a door stop mechanism, according to the present invention comprises a bottom portion having a bottom hollow section and a top portion on the bottom portion. The top portion has a top hollow section facing the bottom hollow section. A spring is arranged in the top and bottom hollow sections. A first end of the spring is attached to the top portion and a second end of the spring is attached to the bottom portion. The spring holds the top portion to the bottom portion in alignment while also allowing the top portion to move in relation to the bottom portion in response to a force. The spring also returns the top portion in alignment with the bottom portion when the force is removed.

14 Claims, 15 Drawing Sheets

(56) References Cited

U.S. PATENT DOCUMENTS 895,115 A * 8/1908 Sevigny ..... E05F 5/025 33/DIG. 6
897,478 A * 9/1908 Newton ..... E05F 5/025 292/120
952,511 A * 3/1910 Chambre ..... E05F 5/025 16/86 A
1,044,412 A * 11/1912 Newton ..... E05F 5/025 16/86 A
1,122,133 A * 12/1914 Lawler ..... E05F 5/08 16/85
1,122,199 A * 12/1914 Gadbois ..... E05C 17/365 292/264
1,211,480 A * 1/1917 Newton ..... E05F 5/025 33/DIG. 6
1,232,000 A * 7/1917 Chase ..... E05F 5/025 16/86 A
1,394,889 A * 10/1921 Foedisch ..... E05F 5/06 292/DIG. 16
1,472,531 A * 10/1923 Morris ..... E05C 17/203 16/82
1,628,826 A * 5/1927 Covalence ..... E05F 5/06 16/85
1,886,112 A * 11/1932 Luarde ..... A47B 91/04 248/188.4
1,983,784 A * 12/1934 Watkins ..... E05F 5/06 267/180
2,189,048 A * 2/1940 Underhill ..... E05F 5/06 16/86 A
2,451,848 A * 10/1948 Martin ..... E05F 5/06 16/86 R
2,479,597 A * 8/1949 Anton ..... E05F 5/06 16/86 A
2,700,788 A * 2/1955 Hennelly ..... E05F 5/06 267/179
2,738,246 A * 3/1956 Hogan, Jr. ..... F16B 12/52 248/188.8
D178,366 S * 7/1956 Heyer ..... D8/402
2,760,224 A * 8/1956 Hennelly ..... E05F 5/06 248/205.5
2,761,718 A * 9/1956 Tool ..... E05C 17/56 D8/402
2,808,609 A * 10/1957 Schultz ..... E05F 5/06 16/86 A
D191,784 S * 11/1961 Ingram ..... D8/402
3,011,818 A * 12/1961 Matthiessen ..... E05C 17/36 292/DIG. 43
3,158,392 A * 11/1964 Shell ..... E05C 17/36 292/DIG. 43
3,160,912 A * 12/1964 Heyer ..... E05F 5/06 16/85
3,172,144 A * 3/1965 Jamison ..... E05F 5/06 16/86 A
3,180,666 A * 4/1965 Jorgensen ..... E05C 17/52 403/90
3,300,239 A * 1/1967 Dinkin ..... E05C 17/56 292/251.5
3,891,257 A * 6/1975 Wilson ..... E05C 17/36 292/262
4,218,807 A * 8/1980 Snow ..... E05F 5/08 292/DIG. 19
4,782,553 A * 11/1988 Morrison ..... E05F 5/02 267/140
5,791,612 A * 8/1998 King ..... A47C 7/002 248/188.4
6,015,173 A * 1/2000 Shang ..... E05F 5/08 292/288
6,651,295 B2 * 11/2003 Hodson ..... E05F 5/08 16/86 A
D652,714 S * 1/2012 Vu ..... D6/709
D665,248 S * 8/2012 Vu ..... D6/709
8,893,351 B2 * 11/2014 Payson ..... E05F 5/08 16/85
8,959,711 B1 * 2/2015 Lawrence ..... E05F 5/06 16/82
9,267,317 B2 * 2/2016 Vu ..... E05F 5/06
D793,786 S * 8/2017 Rawls-Meehan ..... D6/709
10,352,082 B1 * 7/2019 Shuba, Jr. ..... E05F 5/08
10,400,496 B2 * 9/2019 Kuta ..... E05C 17/56
10,865,593 B2 * 12/2020 Doherty ..... E05C 17/365
2003/0066163 A1 * 4/2003 Hodson ..... E05C 17/52 16/85
2005/0217072 A1 * 10/2005 Lin ..... E05F 5/02 16/85
2006/0021191 A1 * 2/2006 Huang ..... E05F 5/06 16/82
2007/0245518 A1 * 10/2007 Blair ..... E05F 5/04 16/85
2008/0109988 A1 * 5/2008 Jameson ..... E05F 5/02 16/82
2013/0175419 A1 * 7/2013 Wheeler ..... E05C 17/02 248/354.1
2013/0255033 A1 * 10/2013 Vu ..... E05F 5/06 49/506
2014/0319881 A1 * 10/2014 Waskie ..... E05C 17/12 296/193.11
2015/0361706 A1 * 12/2015 Catalano ..... E05F 5/06 16/82
2015/0361707 A1 * 12/2015 Swanberg ..... E05F 5/06 16/83
2016/0010790 A1 * 1/2016 Ruckman ..... E04F 21/1855 248/419
2016/0047157 A1 * 2/2016 Duff ..... E05C 17/36 16/85
2017/0211301 A1 * 7/2017 Richmond ..... E05B 63/18
2021/0131154 A1 * 5/2021 Cunningham ..... E05C 17/16
2022/0120121 A1 * 4/2022 Linden ..... E05C 17/44

* cited by examiner

RIGIDFLEX DOOR STOP

.625
.376
R.030
R.015
R.250
THREAD TO ACCEPT SPRING
Ø.250
3.500
A
.880
96.00°
R.250
R.015
0.0410 WIRE GROOVE
DETAIL A
SCALE 10
Ø1.000
Ø.125
PROJECT
Door Stopper
TITLE
Door Stop Assembly
SIZE
B
CODE
DWG NO
REV
SCALE 3
WEIGHT
SHEET 1/1
APPROVED
CHECKED
DRAWN
152
162
157
159
158
156
154
164
152

150 ~

150

SPLIT RIGID AND FLEXIBLE DOOR STOP MECHANISM

This application claims the benefit us U.S. Provisional Patent Application Ser. No. 62/916,767 filed on Oct. 17, 2019.

BACKGROUND

Field

The present invention relates generally to door stops, and more particularly to door stop mechanisms that are split along their length and are flexible.

Description of the Related Art

One conventional and common type of doorstop comprises a rigid shank with a cushioned top at one end and a screw at the other end adapted to be threaded into the door or wall baseboard. Such rigid doorstops have a number of disadvantages. The first and most common being that a rigid doorstop easily breaks or pulls out of the door or wall baseboard that it is attached to. Also, If the door swings back against the wall with sufficient force, the rigid doorstop may damage the door notwithstanding the cushioned tip. Further, a rigid doorstop does not yield when impacted from the side or from downward pressure, as from someone stepping on it, a mop or broom smacking into it or a machine like a vacuum or floor cleaning device running over it. When a rigid doorstop is hit with sufficient force the doorstop will most likely rip away from the door or the wall baseboard, increasing the likelihood of damage to the wall from the door handle pushing into it.

Flexible (Spring Type) doorstops are also very well known. This common type of flexible doorstop is similar to the rigid doorstop, except that the rigid shank is replaced by a coil spring. These flexible type doorstops can hold up somewhat better when hit or stepped on and can reduce the risk of damage to the wall. A disadvantage of these spring type door stops is that they are considered visually unappealing, limited in design and aesthetically less desirable by architects and customers alike. They also easily fail and will buckle under the impact of pressure pushing down on it or being hit from the side, leaving it deformed and ineffective at protecting the wall.

SUMMARY

The present invention relates generally to door stops and door stop mechanisms for preventing a door from swinging back against a wall, and more particularly, to a flexible, wall mounted doorstop to absorb the impact of the swinging door or other mechanisms imparting a sideways force. It takes the two most common and popular types of door stops currently being used and incorporates them into one. It offers the aesthetics and design variations of rigid doorstops and the functionality of a spring type doorstop. The door stops are arranged to absorb the force, flex, and return, without damage to the mechanism. The door stops and mechanisms according to the present invention are flexible, rugged and visually appealing.

One embodiment of a door stop mechanism, according to the present invention comprises a bottom portion having a bottom hollow section and a top portion on the bottom portion. The top portion has a top hollow section facing the bottom hollow section. A spring is arranged in the top and bottom hollow sections. A first end of the spring is attached to the top portion and a second end of the spring is attached to the bottom portion. The spring holds the top portion to the bottom portion in alignment while also allowing the top portion to move in relation to the bottom portion in response to a force. The spring also returns the top portion in alignment with the bottom portion when the force is removed.

These and other further features and advantages provided in this disclosure would be apparent to those skilled in the art from the following detailed description, taken together with the accompanying drawings.

DETAILED DESCRIPTION

Figure 1:
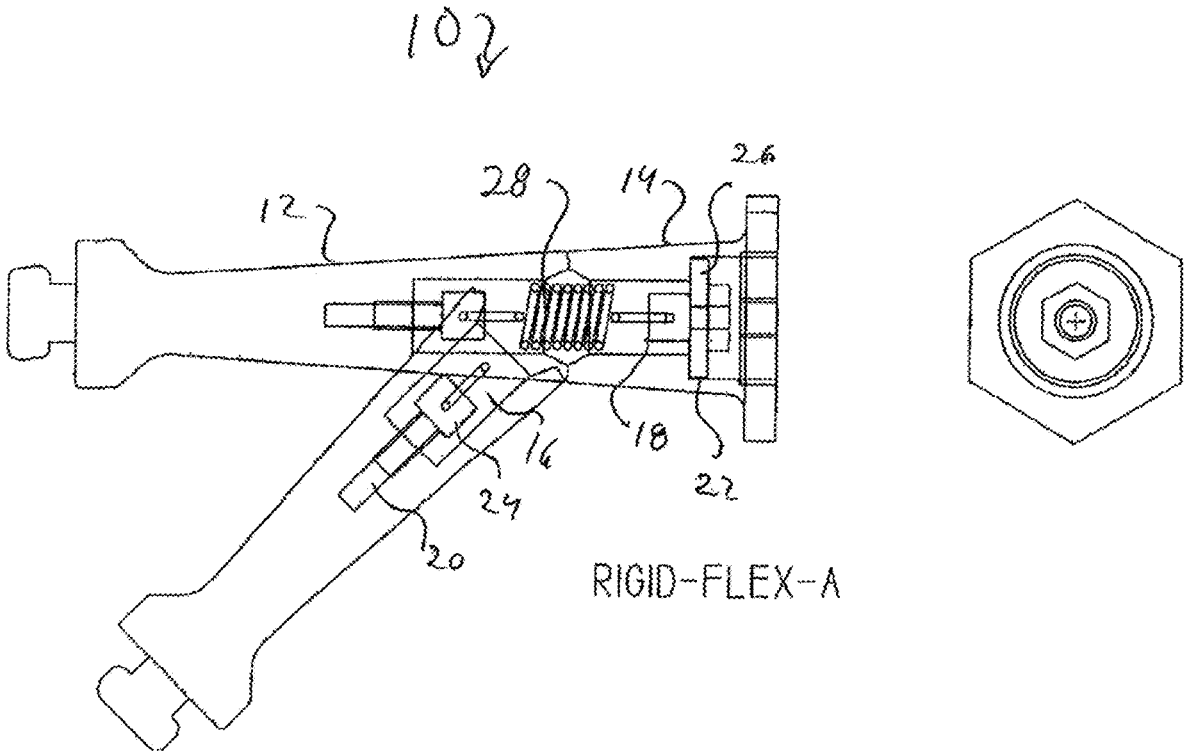
FIG. 1 is a side sectional view of one embodiment of a door stop mechanism according to the present invention.
Figure 2:
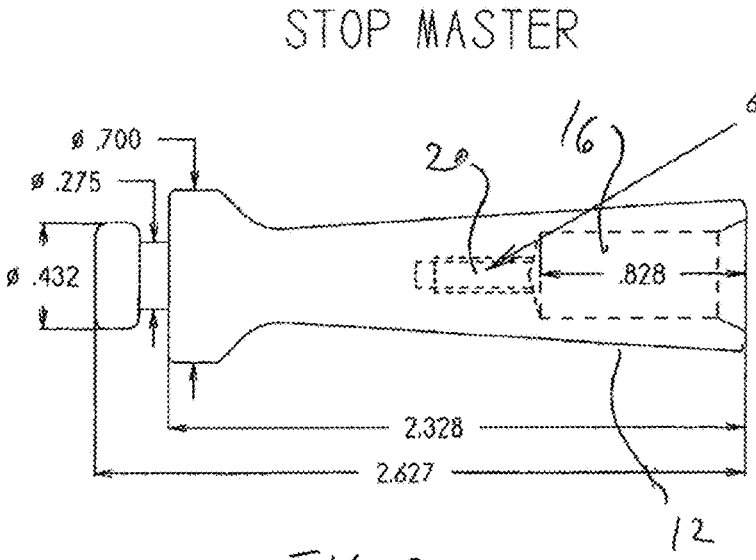
FIG. 2 is a side sectional view of the top portion of the door stop mechanism shown in FIG. 1.
Figure 3:
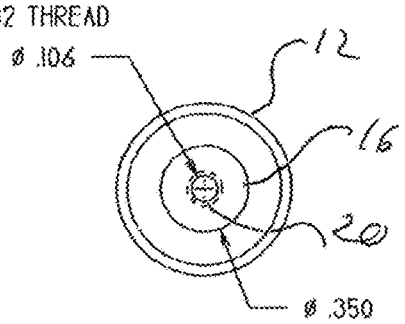
FIG. 3 is an end view of the top portion shown in FIG. 2.
Figure 4:
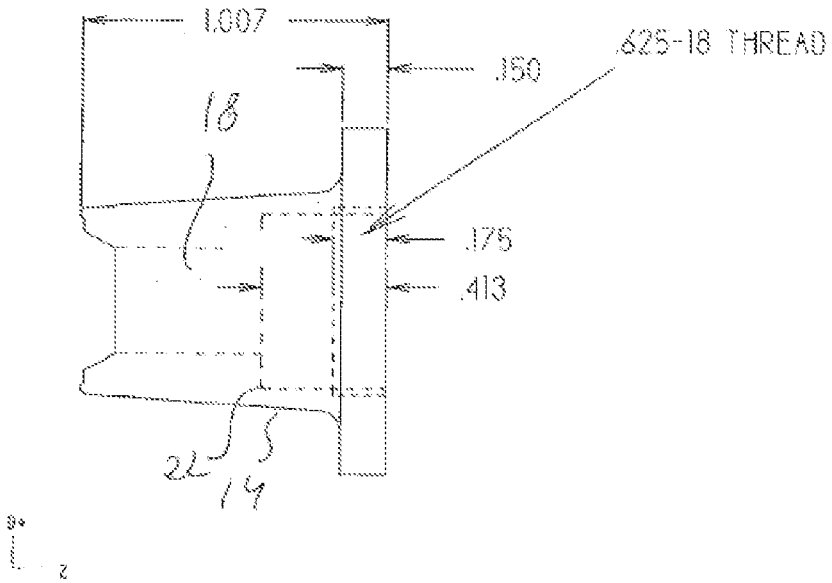
FIG. 4 is a side sectional view of a bottom portion of the door stop mechanism shown in FIG. 1.
Figure 5:
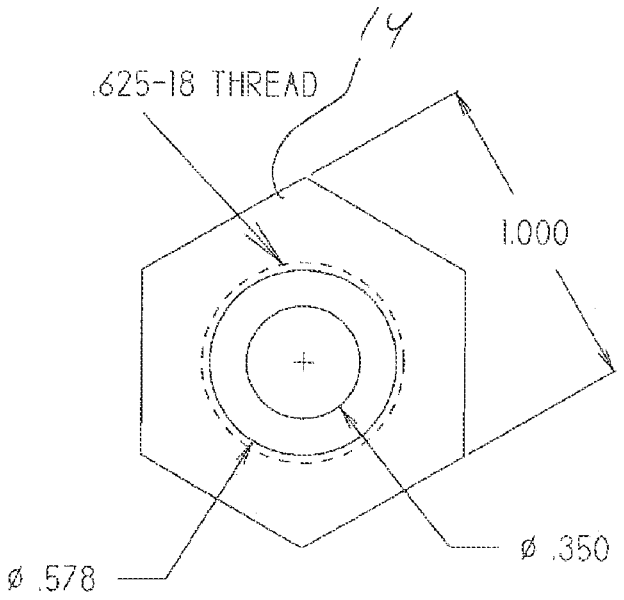
FIG. 5 is an end view of the bottom portion shown in FIG. 4.
Figure 6:
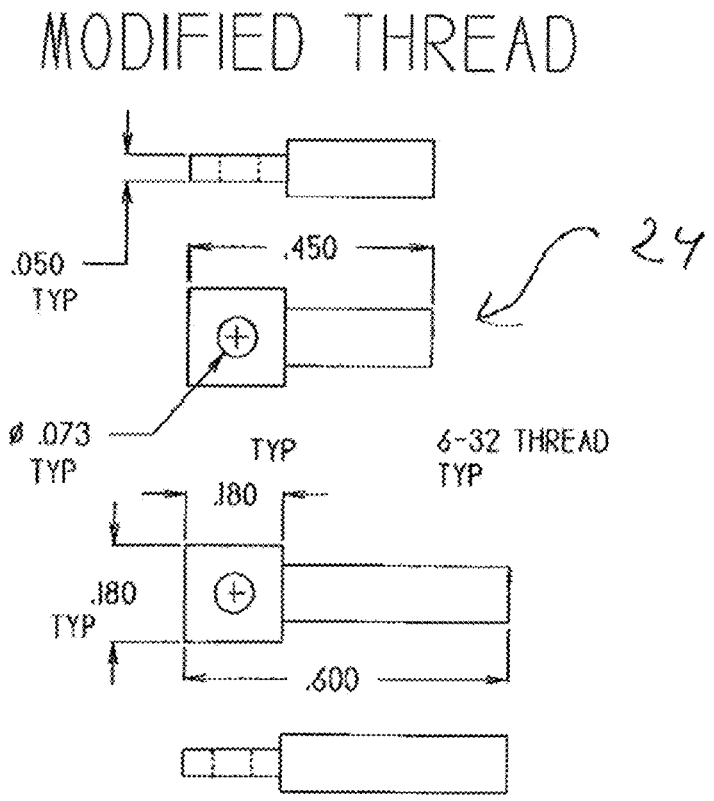
FIG. 6 are side views of different threaded anchor portions that can be used with to top section of the door stop mechanism shown in FIG. 1.
Figure 7:
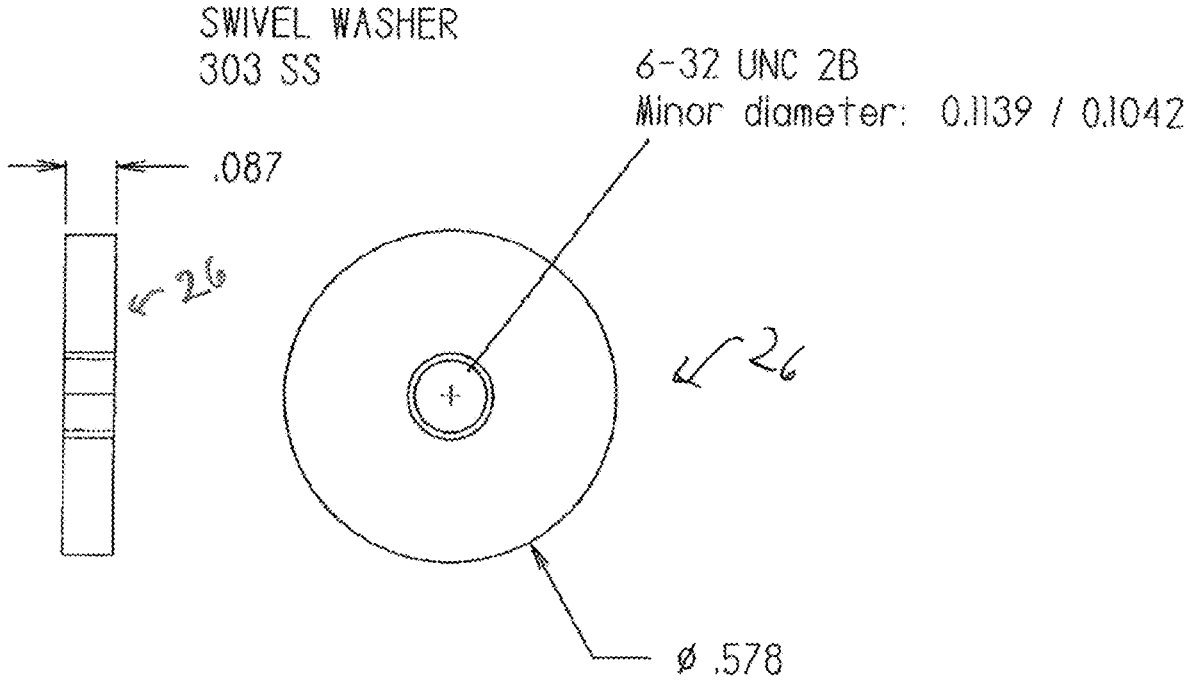
FIG. 7 are views of a swivel washer that can be used with the door stop mechanism shown in FIG. 1.
Figure 8:
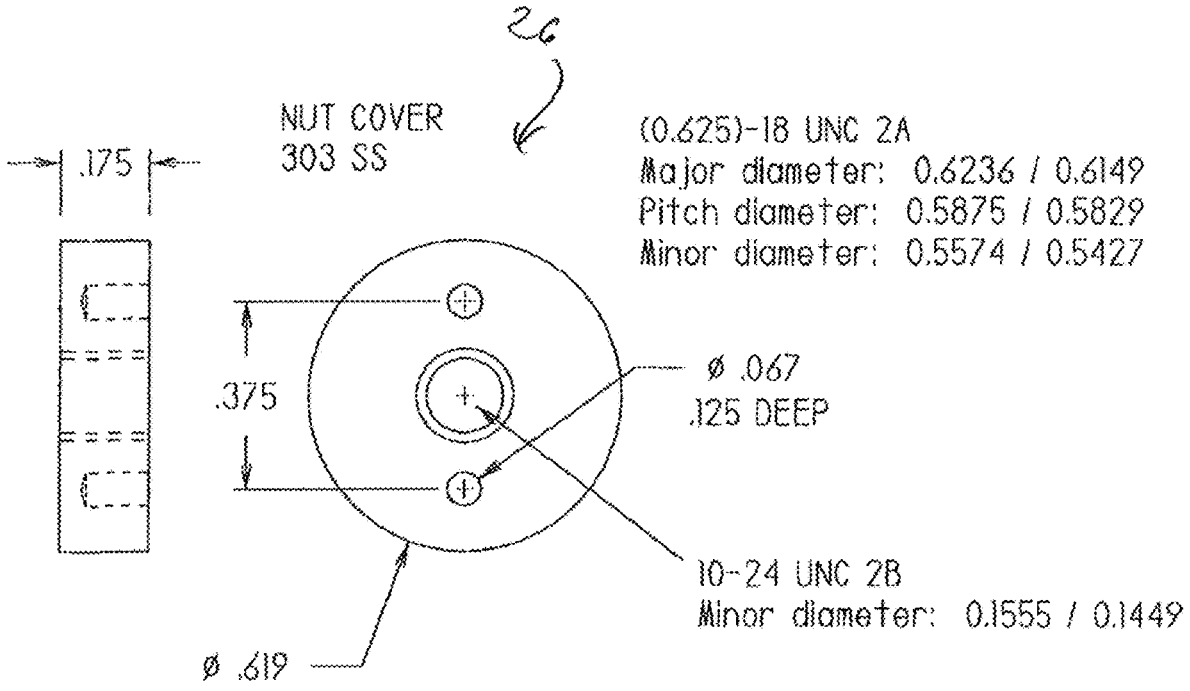
FIG. 8 are views of a nut cover that can be used with the door stop mechanism shown in FIG. 1.

Devices described herein can comprise novel and improved designs for door stop mechanisms that are not only flexible, but are rugged and visually appealing. The door stop mechanism according to the present invention can appear as a unitary shank or stem ("stem"), but can comprise a split along the length of the stem so that the stem comprises a top and bottom portion. Both the top and bottom portion can be at least partially hollow to house an internal spring that is not visible when the top and bottom portions are aligned. In some embodiments, and anchor mechanism can be included to hold the spring in place. In other embodiments, the inside surfaces of be hollow portions can be threaded and the hollow portions can be appropriately sized so the spring can be turned on the threads to anchor the string in place. The tip of the top portion of the stem can comprise a rubber tip and can cushion the impact of a door with the stem. At the opposing end, the bottom portion will have a screw stem anchor attaching the door stop mechanism into the door or wall base board.

In embodiments having an internal spring and anchor mechanism, they can comprise many different components that can be arranged in different ways to hold the top and bottom portions together as one stem, while at the same time allowing the top portion to flex in relation to the bottom portion. In some embodiments the components can comprise a top portion anchor that can be threaded into the top portion. It also comprises a bottom portion anchor that can be threaded into the bottom portion. A spring is then connected between the top portion anchor and bottom portion anchor.

When a door or other device strikes the door stop mechanism at an angle, the spring can allow the top portion to flex in relation to the bottom portion. When the force is removed, the spring causes the top portion to return to alignment with the bottom portion. This allows the door stop mechanism to bear the angle force and return to aligned position without damage to the door stop mechanism. This can be particularly useful when a foot, mop, vacuum cleaner, etc., strikes the door stop mechanism. The door stop mechanism can absorb the striking force, flex, and then return to its aligned position without damage to the door stop mechanism.

The door stop mechanism provides the further advantage of being visually appealing. The spring mechanism for the stop is hidden from view and the split between the top and bottom portion may not be visible to a casual observer. This allows for the more desirable appearance of a solid stem, while also allowing for the flexibility to avoid damage when being struck at different angles.

Throughout this disclosure, the preferred embodiment and examples illustrated should be considered as exemplars, rather than as limitations on the present disclosure. As used herein, the term "invention," "device," "apparatus," "method," "disclosure," "present invention," "present device," present apparatus," "present method," or "present disclosure" refers to any one of the embodiments of the disclosure described herein, and any equivalents. Furthermore, reference to various feature(s) of the "invention," "device," "apparatus," "method," "disclosure," "present invention," "present device," "present apparatus," "present method," or "present disclosure" throughout this document does not mean that all claimed embodiments or methods must include the referenced feature(s).

It is also understood that when an element or feature is referred to as being "on" or "adjacent" to another element or feature, it can be directly on or adjacent to the other element or feature or intervening elements or features may also be present. In contrast, when an element is referred to as being "directly on" or extending "directly onto" another element, there are no intervening elements present. Additionally, it is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Furthermore, relative terms such as "inner," "outer," "upper," "top," "above," "lower," "bottom," "beneath," "below," and similar terms, may be used herein to describe a relationship of one element to another. Terms such as "higher," "lower," "wider," "narrower," and similar terms, may be used herein to describe angular relationships. It is understood that these terms are intended to encompass different orientations of the elements or systems in addition to the orientation depicted in the figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. For example, when the present specification refers to "an" assembly, it is understood that this language encompasses a single assembly or a plurality or array of assemblies. It is further understood that the terms "comprises," "comprising," "includes," and/or "including" when used herein, specify the presence of stated features, integers, steps, operations, elements, and/or components, but do not preclude the presence or addition of one or more other features, integers, steps, operations, elements, components, and/or groups thereof.

Embodiments as described in the present disclosure can be described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

FIGS. 1-8 shows one embodiment of a door stop mechanism 10 according to the present invention along with the components comprising the door stop mechanism 10. In the embodiment shown, the door stop mechanism generally comprises a top portion 12 and bottom portion 14. The top portion comprises a top portion hollow section 16 that faces a bottom portion hollow section 18 in the bottom portion 14. The base of the bottom portion can be shaped to cooperate with different tools, such as a wrench, used when mounting the door stop mechanism in place, such as to a wall or baseboard.

The upper portion of the top portion hollow section 16 comprises a top portion threaded hole 20, and the bottom portion 14 can have a bottom portion threaded section 22. The top portion threaded hold 20 is arranged to cooperate with the top anchor 24 and the bottom portion threaded section 22 is arranged to cooperate with a bottom anchor 26. The spring 28 is connected between and spans the distance between the top and bottom anchors 24, 26. The spring 28 should be strong enough to hold the top and bottom portions 12, 14 in alignment, while at the same time flexible enough to allow the top portion 12 to flex in relation to the bottom portion 14.

The facing edges of the top and bottom portions 12, 16 can be shaped such that the edges rest in close proximity to one another. This not only helps in holding the top and bottom portions 12, 14 in alignment, but also helps obscure the split between the top and bottom portions 12, 14. This helps the mechanism 10 appear as a unitary step, providing a more visually appealing device. In the embodiment shown, the edge of the top portion 12 is convex and edge of the bottom portion 14 is concave and shaped to mate with the edge of the top portion 12.

It is understood that the door stop mechanisms according to the present invention can be made of many different materials, and can have many different components. The door stop mechanisms preferably comprise a rugged and rigid material such as a metal or plastic, or combinations thereof It is also understood that the split in the stem can be in many different locations. The components can also be arranged in many different ways. For example, the bottom anchor may not be threaded and could be held in place by the pulling force of the spring 28.

Figure 9:
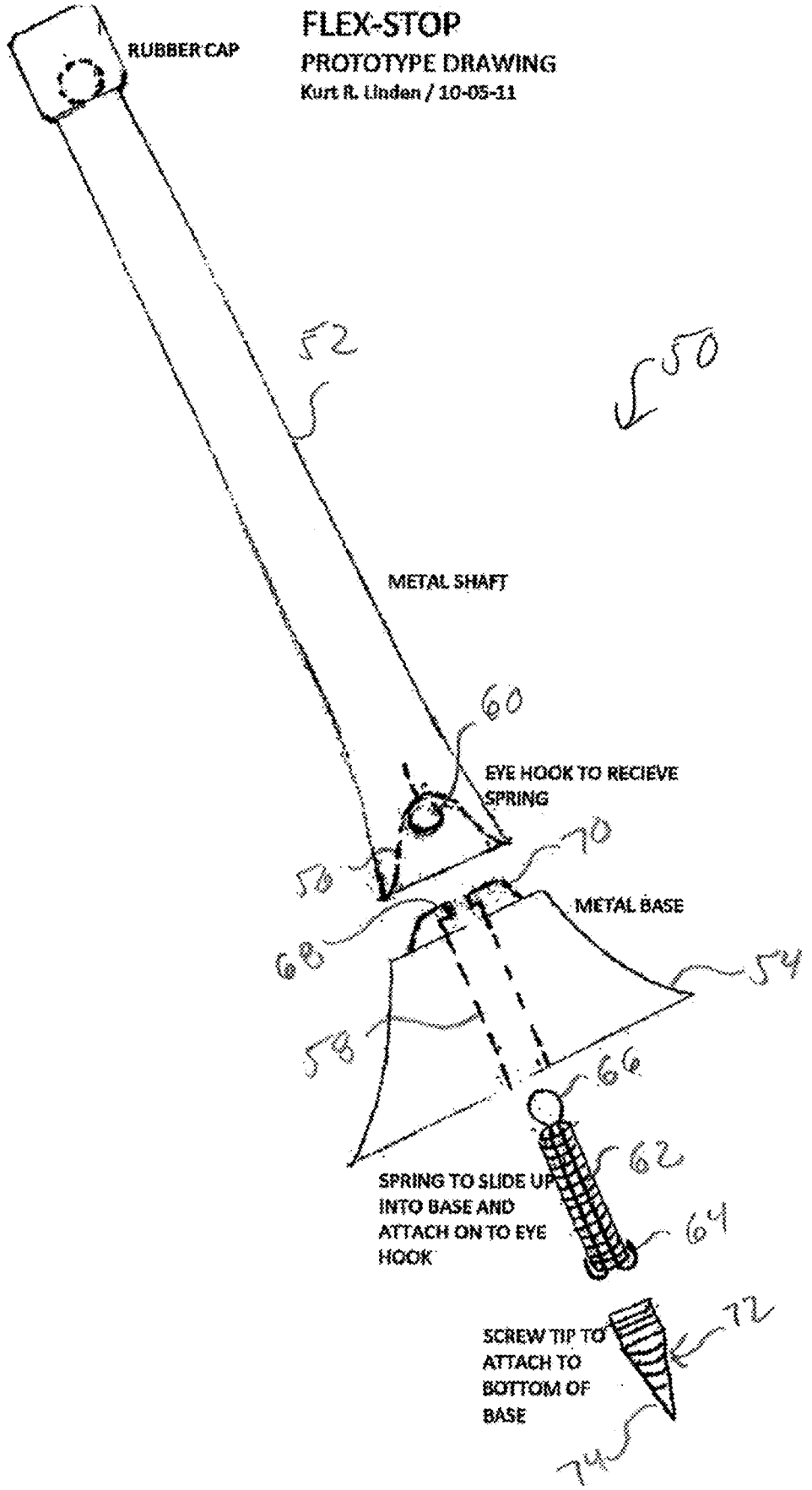
FIG. 9 is a side sectional view of another embodiment of door stop mechanism according to the present invention.

FIG. 9 shows another embodiment of a door stop mechanism 50 according to the present invention having to and bottom portions 52, 54 with different components for holding together the top and bottom portions 52, 54. Like the embodiment above, the door mechanism 50 can comprise a top portion hollow section 56 and a bottom portion hollow section 58. The upper surface of the top hollow section 56 can have a mechanism for connecting to a spring, with the embodiment shown comprising an eye hook 60.

The mechanism 50 further comprises a spring 62 that is sized so that it can be inserted in the bottom hollow section 58. The bottom section 64 of the spring 62 is widened so that the spring with not pass entirely through the bottom hollow section 58 with the bottom section abutting the lip 68 at the top of the bottom hollow section 58. The spring 62 has an upper loop 64, and when the spring is inserted in the hollow bottom section 58 at least a portion of it passed though the hole in the bottom section 58 and the ridge 68. The spring 62 has an upper loop 66 that connects to the eye hook 60, with the spring 62 being held between the eye hook 60 and the ridge 68.

Like above, the spring 62 should be strong enough to hold the top and bottom portion 52, 54 together and in alignment, while still allowing for the top portion 52 to flex in relation to the bottom portion 54. The top surface 70 of the bottom portion 54 can be curved and sized to fit closely in the top hollow portion 58. This curved portion 70 provides for smooth and reliable flexing and return of the top portion 52 in relation to the bottom portion 54. The mechanism 50 also comprises a screw tip 72 that can be threaded into the bottom hollow section 58 and provides and pointed threaded portion 74 that can be threaded into a wall or baseboard to mount the mechanism 50.

Figure 10:
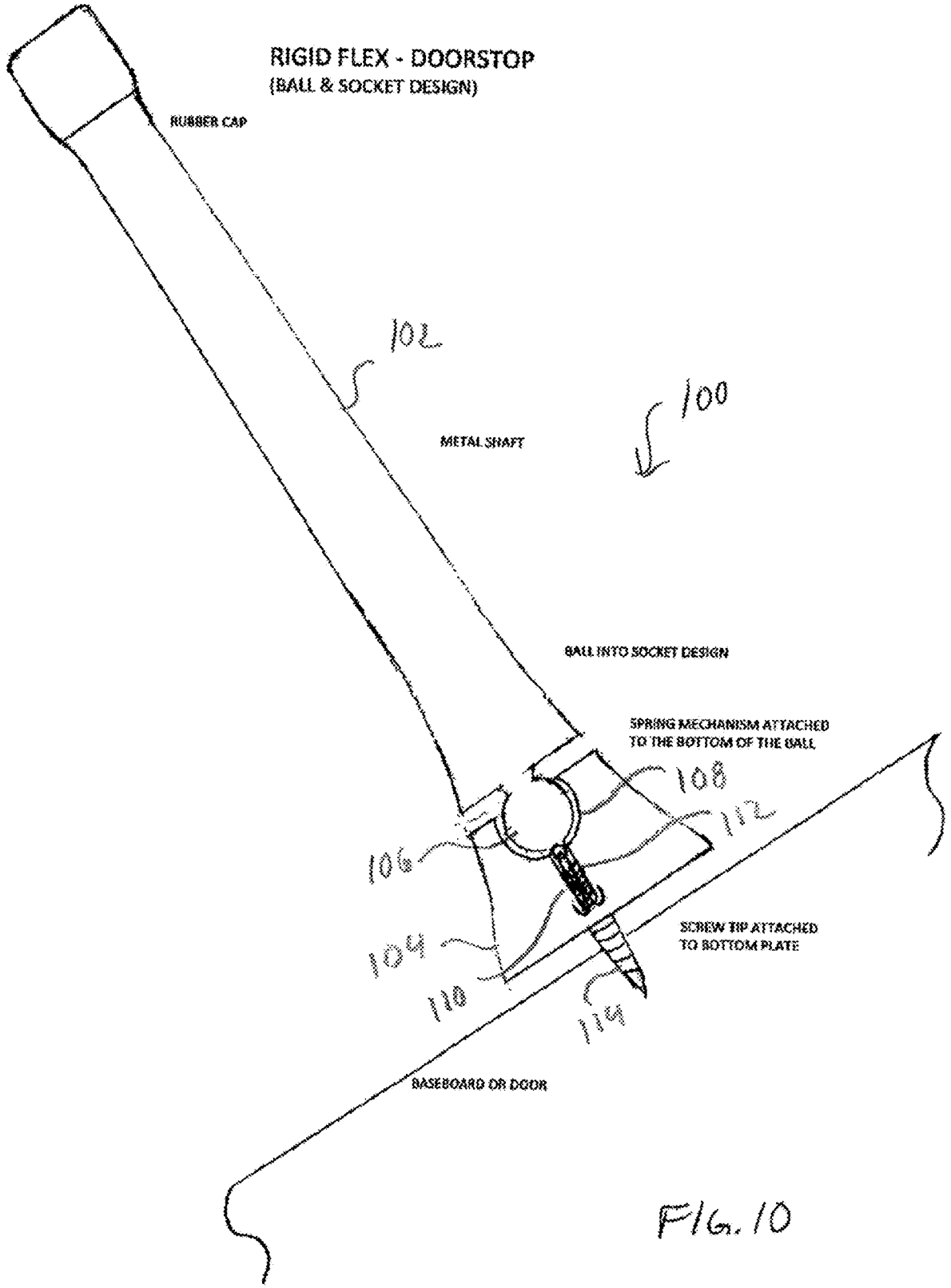
FIG. 10 is a side sectional view of still another embodiment of a door stop mechanism according to the present invention.
Figure 11:
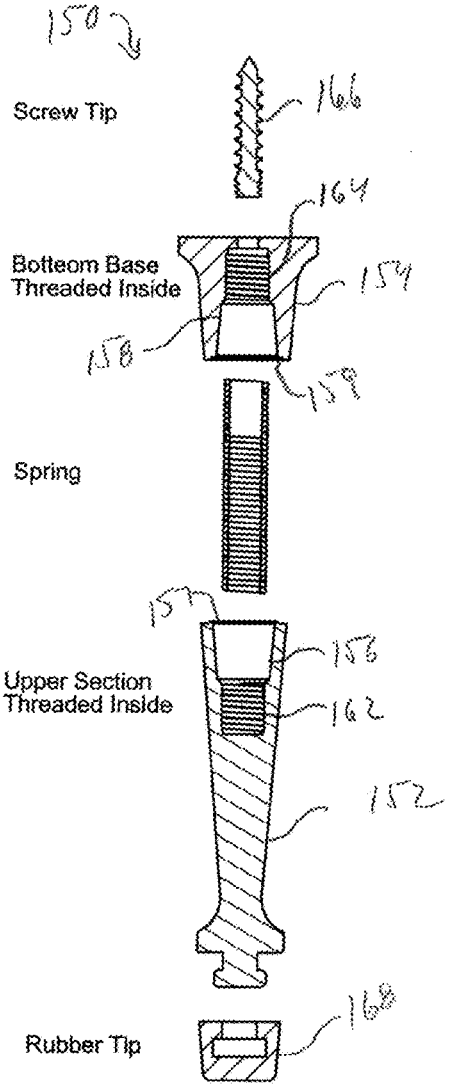
FIG. 11 is a sectional exploded view another embodiment of a door stop mechanism according to the present invention
Figure 12:
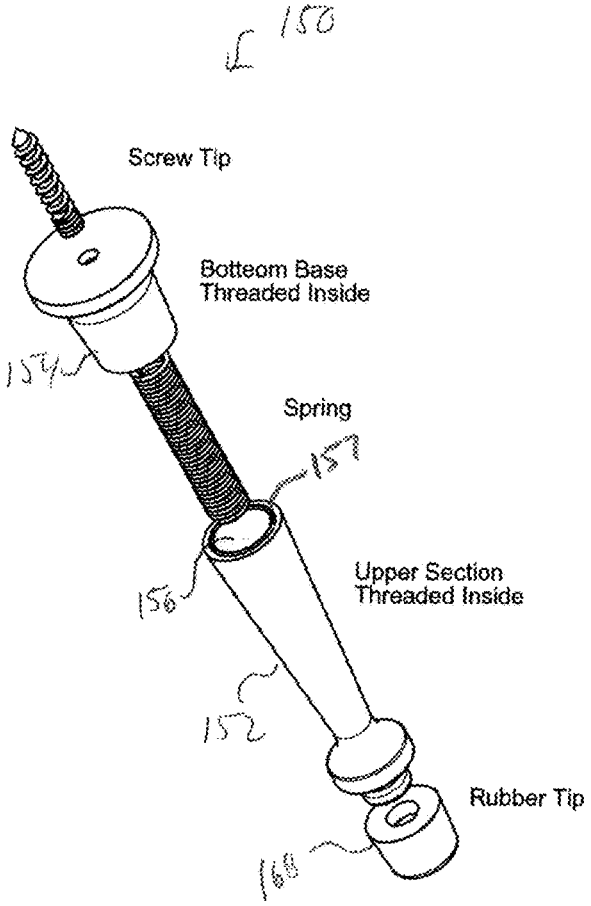
FIG. 12 is an exploded perspective view of the door stop mechanism shown in FIG. 11.
Figures 13, 14:
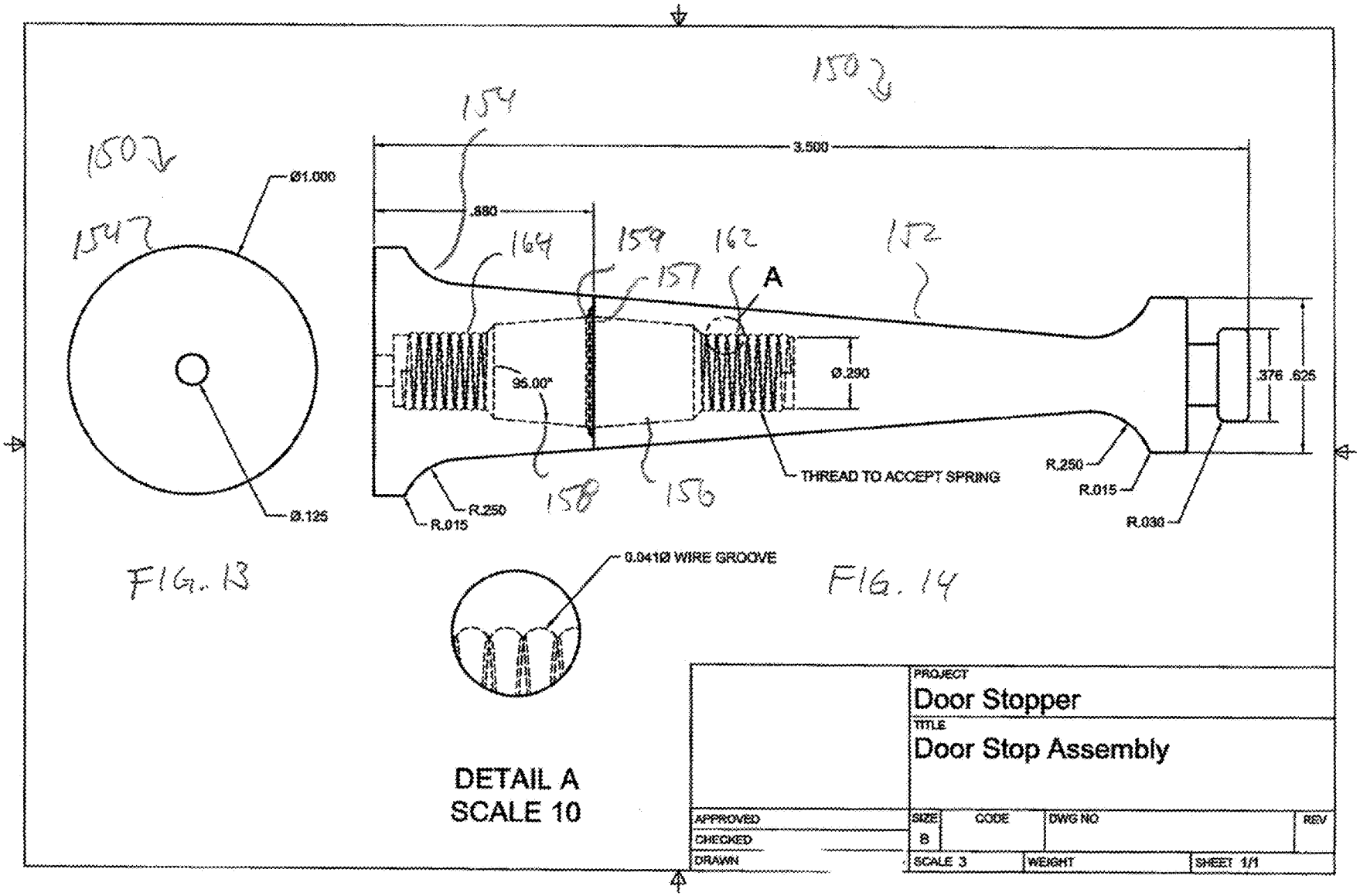
FIG. 13 is bottom view of the bottom portion of the door stop mechanism shown in FIG. 11.
FIG. 14 is a side sections view of the top and bottom portions of the door stop mechanism shown in FIG. 11.

Similarly, FIG. 10 shows another embodiment of a door stop mechanism 100 with different components for holding the top and bottom portions 102, 104 together. In this embodiment the top portion 102 has a ball 106 that is sized to fit in a hole 108 in the bottom portion 104. The bottom portion 104 also comprises a hollow section 110 to hold a spring 112. The spring 112 is connected to the ball 106 and holds the top portion 102 to the bottom portion 104. The top portion 102 flexes in relation to the bottom portion 104 with the ball 106 riding on the surface of the hole 108. Screw tip 114 is included that is similar to the screw tip 72 shown in FIG. 9 and described above.

FIGS. 11-14 show still another embodiment of a door stop mechanism according to the present invention also having a top portion 152, bottom portion 154, top hollow section 156, bottom hollow portion 158 and spring 160. In this embodiment at least part of the inner surface of the top and bottom hollow sections 156, 158 are threaded and have a diameter to accommodate that spring 160. In the embodiment shown, both the top and bottom hollow sections 156 and 158 are widened where they meet. Moving further away from the meeting location, the top hollow section 156 has a top threaded portion 162 and the bottom hollow section 158 has a bottom threaded portion 164. The top and bottom threaded portions 162, 164 have threads and a diameter to mate with the spring 160. The spring 60 is held to the top portion 152 by turning the spring 60 onto the top threaded portion 162 and the spring 60 is held to the bottom portion 154 by turning the spring 160 onto the bottom threaded portion 164.

Like above, the spring 160 is strong enough to hold the top and bottom sections 152, 154 in alignment but still allows for flexing of the top section 152 in relation to the bottom section 154. The widened portion of the top and bottom hollow sections 156, 158 provide space to allow the spring 160 to flex and return with flexing of the top portion 152 in relation to the bottom portion 154. The mechanism also comprise a screw tip 166 is included that is similar to the screw tip 72 shown in FIG. 9 and described above and a rubber tip 168. The bottom edge of top portion 152 can also have a lip 157 that is designed to rest in an indent 159 in the top edge of the bottom portion 154. This helps guide the top section 152 to proper alignment with the bottom section 152 under force of the spring 160.

The door stop mechanism 150 can be assembled by turning the spring 160 into the threaded section 164 of the bottom portion 154 and then turning the spring 160 into the threaded section 162 of the top portion 152. An epoxy can then be included in at least part of the hollow portions 156, 158 to prevent the spring from unscrewing during use. The screw tip 166 can then be screwed into the bottom portion 154 and an epoxy can be included to prevent the screw tip from unscrewing during use. The rubber tip 168 is then installed at the end of the top section 152.

Figure 15:
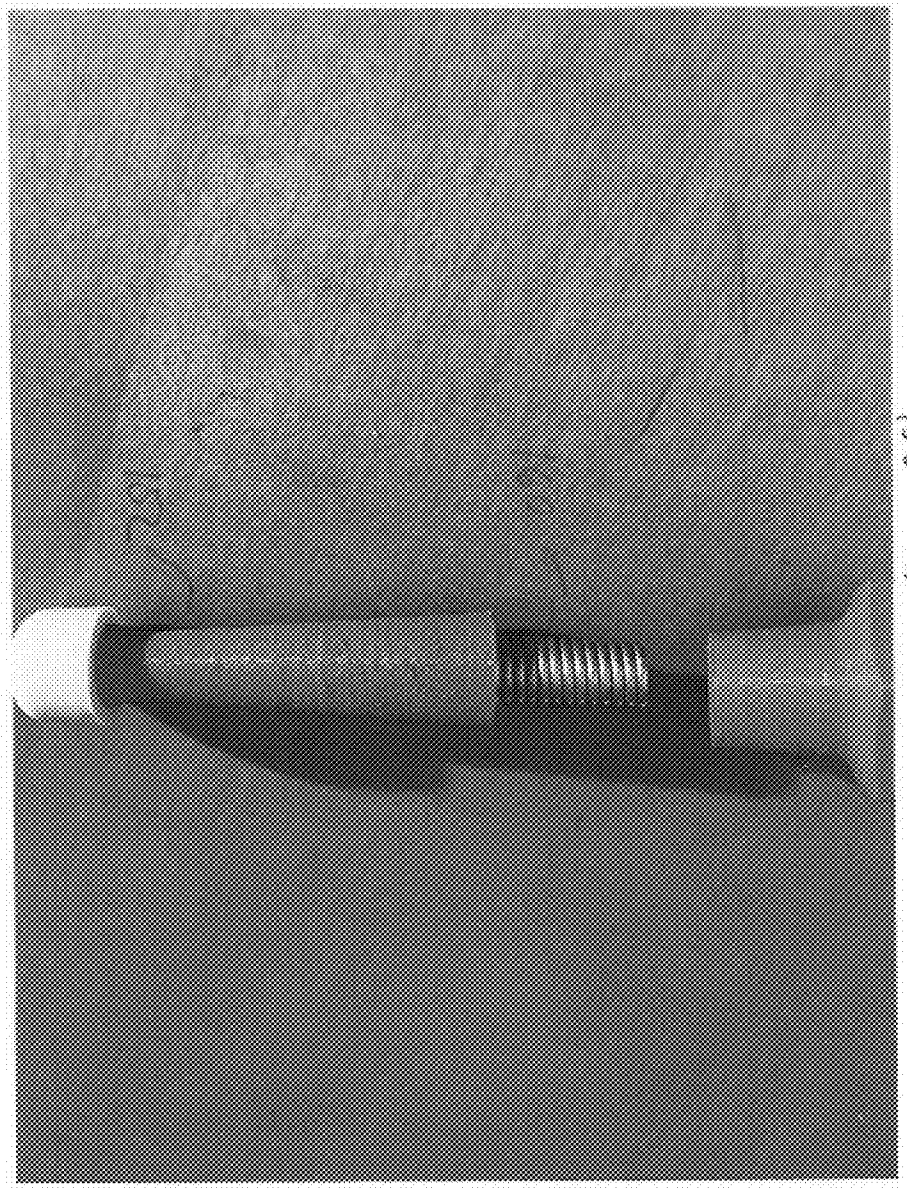
FIG. 15 is side view of the door stop mechanism shown in FIG. 11 during an assembly step.
Figure 16:
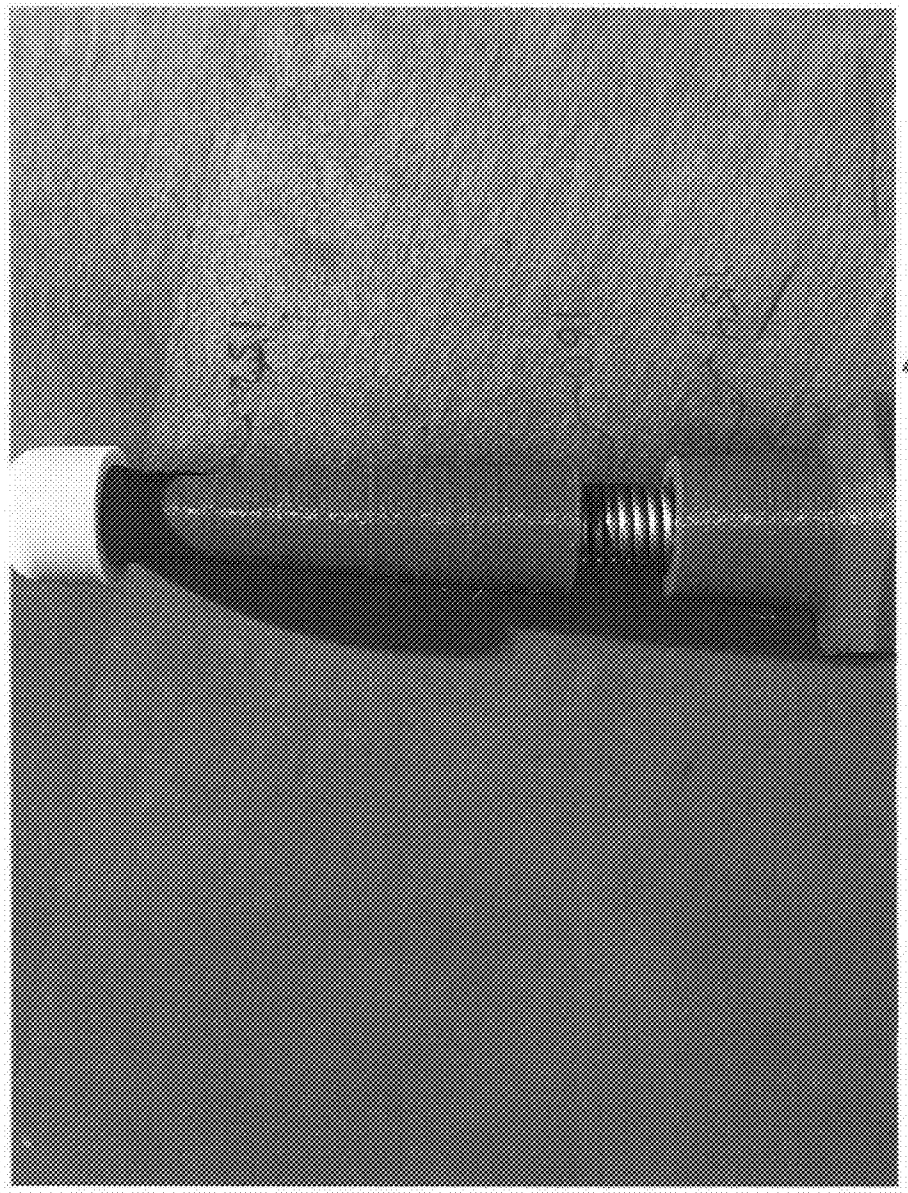
FIG. 16 is another side view of the door stop mechanism shown in FIG. 11 at a subsequent assembly step.
Figure 17:
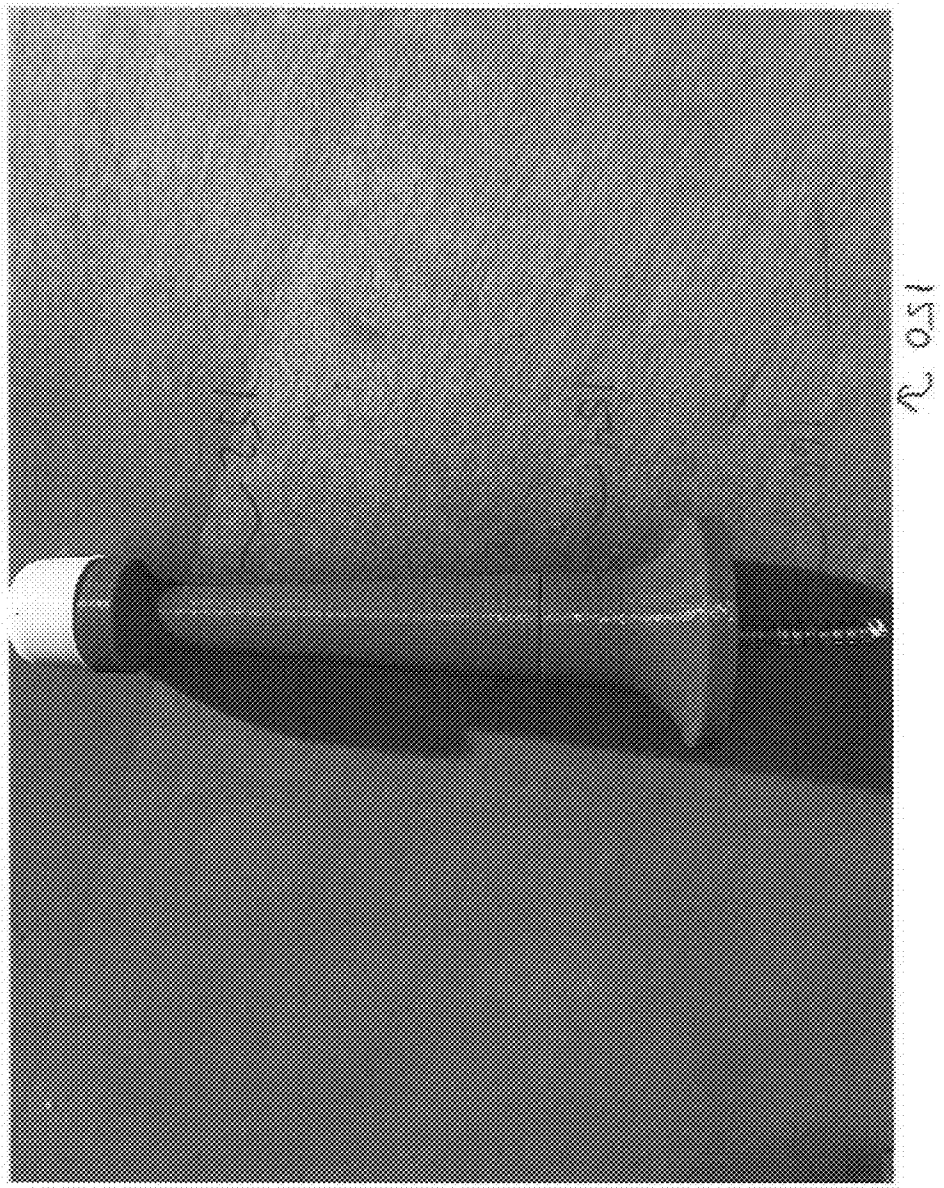
FIG. 17 is still another side view of the door stop mechanism at another subsequent assembly step.

FIG. 15-18 show the door stop mechanism 150 during assembly and operation. Referring first to FIG. 15, the spring 160 is shown after being turned into the top portion 152 to mate one end of the spring 160 with upper threaded portion (not visible in FIG. 15 but shown and described above). This mounts the spring 160 to the top port 152. Referring not to FIG. 16, the top portion 152 with the spring 160 can be turned into the bottom portion 154 to mate the other end of the spring 160 to the bottom threaded portion 164. This mounts the spring 160 to the bottom threaded portion (similarly not visible). Epoxy can be included in different locations to ensure that the spring 160 does not loosen from the threaded portions during use. The top portion can continue to turn the spring 160 into the bottom threaded portion until the top portion 152 abuts the bottom portion as best shown in FIG. 17.

Figure 18:
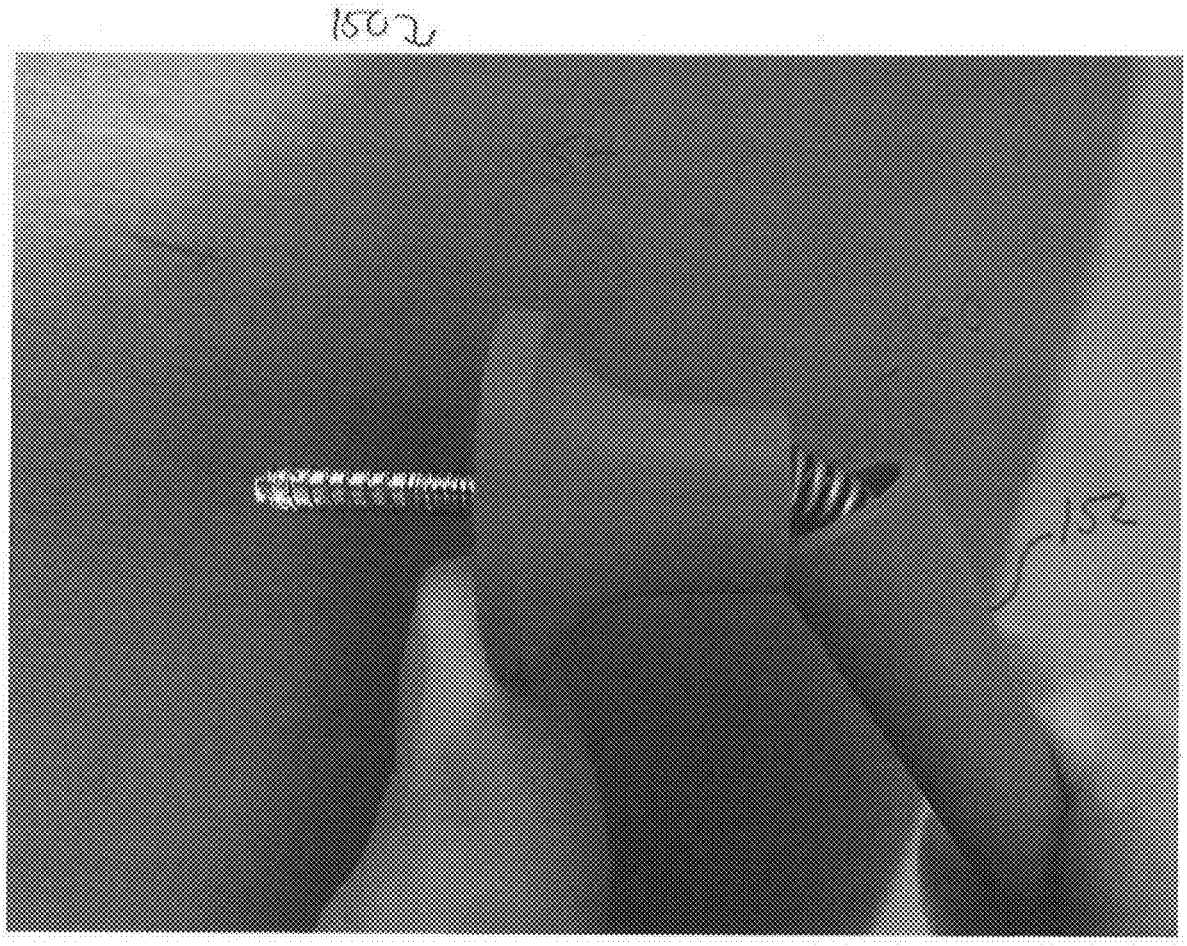
FIG. 18 is side view of the door stop mechanism shown in FIG. 11, with the top portion flexing in relation to the bottom portion.

FIG. 18 shows the assembled mechanism with the top portion 152 being flexed in relation to the bottom portion 154 but a force (e.g. lateral force) applied to the top portion 152. The spring 160 can be visible in the area where the top portion 152 separates from the bottom portion 154 during flexing. When the flexing force is removed, the spring is strong enough to return and hold the top portion 152 in alignment with the bottom portion 154 as shown in FIG. 17.

The assembly method is described above by having the spring 160 turned onto the top portion 152 and then the bottom portion 154. It is understood however, that other assembly methods may have different steps performed in a different order. For example, the spring 160 could be first turned into the bottom portion 154 and then the top portion 152, and epoxy could be introduced at different points during the assembly process. The screw tip 166 shown in FIGS. 17 and 18, can also be mounted to the bottom portion at different times during the manufacturing process.

It is understood that the bottom section can have many different widths and lengths compared to the top section. In some embodiments, the bottom portion can be approximately the same length as the top portion. In other embodiments the bottom portion can be less than half the length of the top portion. Is still other embodiments it can be less than one fourth the length of the top portion. In one embodiment the bottom portion can be 0.88 inches long and the top portion can be 2.62 inches long.

These are only some of the many different arrangements that can be included in different embodiments of the present invention. Although the present disclosure has been described in detail with reference to certain configurations thereof, other versions are possible. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A door stop mechanism, comprising:

a bottom portion having a bottom hollow section that is threaded to mate with the windings of a spring;

a top portion on said bottom portion, said top portion having a top hollow section facing said bottom hollow section, wherein said top hollow section is threaded to mate with a spring, with the threaded top hollow section having the same diameter as said threaded bottom hollow section, and;

a single spring arranged in said top and bottom hollow sections, wherein a first end of said spring is threaded into said top portion and a second end of said spring is threaded into said bottom portion, said spring holding said top portion to said bottom portion in alignment while also allowing said top portion to move in relation to said bottom portion in response to a lateral force, wherein said spring returns said top portion in alignment with said bottom portion when said lateral force is removed; and wherein said bottom portion has a bottom widened hollow section and said top portion has a top widened hollow section directly facing said bottom widened hollow section, facing bottom and top widened hollow sections providing a space for flexing of said spring.

2. The door stop mechanism of claim 1, wherein said bottom portion comprises a screw tip.

3. The door stop mechanism of claim 1, wherein said top threaded section is arranged to allow said spring to mate with said threaded section to attach said first end to said top portion.

4. The door stop mechanism of claim 1, wherein said bottom threaded section is arranged to allow said spring to mate with said bottom threaded section to attach said second end to said bottom portion.

5. The door stop mechanism of claim 1, wherein said top hollow section comprises and top anchor, wherein said first end is attached to said top anchor.

6. The door stop mechanism of claim 1, wherein said bottom hollow section comprises and bottom anchor, wherein said second end is attached to said bottom anchor.

7. The door stop mechanism of claim 1, wherein said top hollow portion comprises and eye hook and said first end comprises a loop to attach to said eye hook.

8. The door stop mechanism of claim 1, wherein said top portion comprises a rubber tip.

9. A door stop mechanism, comprising:

a bottom portion having a bottom hollow section with a bottom threaded section;

a top portion on said bottom portion, said top portion having a top hollow section facing said bottom hollow section, wherein said top hollow section comprises a top threaded section having the same diameter as said bottom threaded section;

a spring arranged in said top and bottom hollow section, wherein a first end of said spring is turned onto and mates with said top threaded section and a second end of said spring is turned onto and mates with said bottom threaded section, said spring holding said top portion to said bottom portion in alignment while also allowing said top portion to move in relation to said bottom portion in response to a force, wherein said spring returns said top portion in alignment with said bottom portion when said force is removed.

10. The door stop mechanism of claim 9, wherein said bottom portion comprises a screw tip.

11. The door stop mechanism of claim 9, wherein said top portion comprises a rubber tip.

12. The door stop mechanism of claim 9, wherein said top hollow section comprises a top widened section having a greater diameter than said top threaded section.

13. The door stop mechanism of claim 12, wherein said bottom hollow section comprises a bottom widened section having a greater diameter than said bottom threaded section.

14. The door stop mechanism of claim 13, wherein said top widened section faces said bottom widened section.

* * * * *